US007532118B2

(12) United States Patent
Gitelis

(10) Patent No.: US 7,532,118 B2
(45) Date of Patent: May 12, 2009

(54) VIBRATION SENSOR FOR BOUNDARY FENCES

(75) Inventor: Asaf Gitelis, P.O. Box 182, Moshav Bnei Atarot (IL) 60991

(73) Assignee: Asaf Gitelis, Moshav Bnei Atarot (IL)

( * ) Notice: Subject to any disclaimer, the term of this patent is extended or adjusted under 35 U.S.C. 154(b) by 618 days.

(21) Appl. No.: 11/153,876

(22) Filed: Jun. 16, 2005

(65) Prior Publication Data

US 2006/0022821 A1 Feb. 2, 2006

(30) Foreign Application Priority Data

Aug. 2, 2004 (IL) ..... 163313

(51) Int. Cl.
*G08B 13/00* (2006.01)
*G08B 23/00* (2006.01)

(52) U.S. Cl. ..... 340/564; 340/687; 340/689; 200/61.45 R; 200/61.52

(58) Field of Classification Search ..... 340/564, 340/686.1, 687, 689, 601; 200/61.45 R, 200/61.52
See application file for complete search history.

(56) References Cited

U.S. PATENT DOCUMENTS 3,569,927 A * 3/1971 Guyton et al. ..... 340/463
3,927,286 A * 12/1975 Fohl ..... 200/61.45 R
4,046,284 A * 9/1977 Samuelsson ..... 221/45
4,107,545 A * 8/1978 Gittelis ..... 307/121
4,136,458 A * 1/1979 Bell et al. ..... 33/561
4,679,158 A * 7/1987 Tate ..... 700/302
4,866,850 A * 9/1989 Kelly et al. ..... 33/366.22
5,278,540 A * 1/1994 Caban-Domenech ..... 340/601
6,452,501 B1 * 9/2002 Tse et al. ..... 340/640
2003/0112735 A1 * 6/2003 Itakura ..... 369/263
2003/0128475 A1 * 7/2003 Wehrenberg ..... 360/250
2004/0040225 A1 * 3/2004 Finkelstein ..... 52/101
2004/0090330 A1 * 5/2004 Gitlis ..... 340/566
2004/0161950 A1 * 8/2004 Coleman ..... 439/22
2004/0239518 A1 * 12/2004 Fong ..... 340/689
2006/0244615 A1 * 11/2006 Koors et al. ..... 340/601

FOREIGN PATENT DOCUMENTS

WO WO/2004/042408 A3 5/2004

* cited by examiner

*Primary Examiner*—Daniel Wu
*Assistant Examiner*—John F Mortell

(57) ABSTRACT

It is an aim of the preferred embodiment, to provide an improved sensor unit that is at least as reliable as two sensor units of the prior art, thereby allowing one unit per fencing unit, i.e. per stretch of fencing between adjacent support posts to provide long term reliability.

12 Claims, 9 Drawing Sheets

VIBRATION SENSOR FOR BOUNDARY FENCES

FIELD OF THE INVENTION

The present invention is directed to providing an improved vibration sensor for security fencing.

BACKGROUND OF THE INVENTION

To minimize the need for human surveillance, and to provide a back up therefore, vibration sensors are in widespread use on fencing such as International borders between States, perimeter fencing around military instalments, prisons and the like. Such sensors give real time indication of attempts to scale or to cut through the fence, and are required to give years of maintenance free service in all weathers.

Such vibration sensors typically comprise a conductive ball supported on three mutually insulated contact supports mounted on a signal cable, such that sudden vibrations displace the ball and momentarily break the circuit sending a signal along the cable. Electronic means can filter out random noise, the effects of wind, birds and the like, and analysis of the frequency of the pulses and their duration can provide an indication of the probable cause.

For optimal performance, vibration sensors of this type are required to be mounted in a perfectly horizontal plane, but particularly along international borders, that follow the relief of the natural terrain, such sensors are fixed to wire fencing that is often situated in hilly, difficult to get to places. Although it will be appreciated that long, maintenance free life is a basic requirement for such sensors. Frequently such sensors are exposed to the elements. One major development that overcame many of the mounting problems and provided protection against the elements was the mounting construction for a motion sensor described in U.S. Pat. No. 4,107,545 to Gittelis, which describes a substantially spherical sensor casing constructed from two substantially hemispherical parts affixed to a complementary socket portion by a clamping means. This construction allows two degrees of freedom, enabling precise angular orientation, of sensor with respect to the fencing, and enabling the ball mounts to be oriented horizontally.

In practice, sensor housings and mounting constructions in accordance with '545 to Gittelis typically included two sensors per housing, mounted in series, the second sensor providing a degree of backup and reliability. Each sensor ball and its support legs were gold plated to provide tarnish free, very low resistance contacts, having resistances of perhaps 0.1-0.2 ohm, and allowing many sensors to be attached in series along large stretches of fencing. However, each vibration dislodged the ball from its tripod like, three-point support, and caused wear in the coating. Similarly, spiking from lightening, and even fluctuations in the signal carrying current over the course of time, resulted in damage to the gold plating, and, to provide long term functioning, the second sensor within the housing was an important backup.

In practice, to provide 8-10 years of trouble free use, each section of fencing, i.e. each span of fencing between adjacent support posts, required two sensor housings, mounted about 0.5 m apart. This was to provide, as a backup to the first sensor housing, an additional safety layer; it being appreciated that a single housing could be intentionally rotated out of the horizontal plane by a terrorist infiltrator or inadvertently displaced by wildlife, such as a bird, for example. Furthermore, if an individual sensor unit (housing containing sensors) were intentionally bypassed by carefully shorting it out, the second sensor unit would still work. Finally, having two sensor units provided four sensors, which gave a high level of reliability. Care was taken that the signal cable connecting the two sensor units was slack, so that each sensor unit worked independently.

The arrangement of two sensor units per stretch of fencing, each containing two sensor balls in series, proved itself by giving reliable service over many years in a variety of weather conditions, and such sensor units became standard along Israeli security fences and International borders, around military installations such as airfields, around factories and prisons in Europe, and around presidential palaces in and prime minister's offices in various countries.

Despite the high reliability of the housings described in '545 to Gittelis, over the years, several shortcomings were noted: Firstly, despite having a drainage hole in the lowest point of the housing, due to the clamping means that covered the hole, moisture seeping into the housing through the cable entry and exit holes, perhaps rain drops running along the cable, sometimes did not adequately drain out through the drainage hole, and such internal moisture sometimes resulted in shorting between contacts, preventing displacement of ball from providing a detectable signal. Secondly, occasionally woodpeckers and magpies drilled holes through the plastic housing, exposing sensor to elements, and sometimes removing the ball. Thirdly, although two balls provide a degree of backup, occasionally the gold contact layer scraped through in both sensors, disconnecting the signal. Fourthly, since gold plated balls having negligible resistance were used, occasionally a clever terrorist using a shorting wire bypassed sensors, and such sabotage sometimes proved very difficult to detect. Fifthly, it will be appreciated that having to mount two sensor housings per section rather than one, significantly increases capital investment, partly due to the unit cost per sensor housing, but mostly being a function of the significant manpower required for correct installation of the sensors and their orientation into the horizontal plane. Sixthly, in transport and prior to installation, the sensor balls suffered a degree of wear due to bouncing about and scraping against mounting supports during transportation, which lowered their useful working life.

Thus, despite the usefulness of the sensor housings described in U.S. Pat. No. 4,107,545 to Gittelis, incorporated herein by reference, there is a need for an improved sensor housing, having novel features that overcome these disadvantages, and the embodiments of the present invention provide such an improved sensor housings.

SUMMARY OF THE INVENTION

It is an aim of the preferred embodiment, to provide an improved sensor unit that is at least as reliable as two sensor units of the prior art, thereby allowing one unit per fencing unit, i.e. per stretch of fencing between adjacent support posts to provide long term reliability.

It is a further aim of the preferred embodiment, to provide an improved sensor unit having improved drainage.

It is yet a further aim of the preferred embodiment, to provide an improved sensor unit that cannot easily be undetectably shorted out by a bypass wire.

It is still yet a further aim of the preferred embodiment, to provide an improved sensor unit that is less susceptible to disturbance from birds.

It is still yet a further aim of the preferred embodiment, to provide an improved sensor unit that is less susceptible to damage during transport.

In a first aspect, the invention is directed to providing a vibration sensor unit comprising a sensor housing consisting of an essentially hemispherical top section and an essentially hemispherical bottom section fastened together by fasteners and having a channel therethrough, through which a signal cable may be run; the sensor housing being supported by a back plate having a concave socket thereon that engages the essentially spherical housing, allowing accurate positioning of sensors therein, with respect to the horizontal; the essentially spherical housing being held against the socket by a clasp that encircles the sensor housing therearound, and being attached to the back plate by fixing means; the back plate including attaching means for attaching it to an installation, wherein the sensor unit comprises six sensors connected in parallel, each sensor comprising a conductive ball supported on electrical contacts.

Optionally electrical contacts supporting each sensor ball are three legs arranged in an equilateral triangle configuration.

In one embodiment, each said leg comprises a miniature sphere supported in a cup on a leg shaped like a miniature golf tee.

In another embodiment, the electrical contacts are a pair concentric rings, the six sensor balls each contacting both concentric rings.

Typically, the six sensors are arranged in a hexagon arrangement.

Optionally, the attaching means is a second plate, such that when installation is a section of wire fencing, a portion of the wire fencing is sandwiched between the back plate and second plate, perhaps using the fixing means.

Typically, the six sensors are connected in parallel by being mounted on a printed circuit board having two rings of contacts.

Optionally, the vibrating sensor unit further comprises a resistor in series with the sensors, providing a significant electrical resistance to sensor unit as a safeguard against being undetectably shorted out.

Preferably, there is provided an improved drainage hole in the lowest point of the bottom hemispherical piece, the improvement being that the drainage hole is mounted within a shallow slot thereby preventing it being blocked by the clamp therearound.

Optionally and preferably a blind hole comprising a tube having an opening in the top end thereof, and a closed bottom end, is provided in center of the essentially hemispherical top section at highest point thereof, enabling the fixing of a pin therein, thereby enabling the sensor unit to be mounted upside down in the socket of a horizontally mounted back plate, via a hole for head of said pin, facilitating substantially wear free transportation thereby.

Optionally, vertical spikes can be mounted thereon to deter perching birds.

In a second aspect, the present invention is directed to a vibration sensor comprising a conductive ball supported on three electrical contact supports arranged in an equilateral triangle arrangement, wherein each contact support comprises a miniature sphere supported in a cup on a leg, such that the cup on the leg resembles a miniature golf tee.

In a third aspect, the present invention is directed to a system for giving warning of infiltration of a security fence, by detecting vibrations of said fence, comprising a series of sensor units as described hereinabove, connected via a cable to a processing means and alarm means.

Typically, the system is characterized by each section of fencing between adjacent support posts having only one sensor thereon.

BRIEF DESCRIPTION OF THE DRAWINGS

For a better understanding of the invention and to show how it may be carried into effect, reference will now be made, to the accompanying drawings whose particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention; the description taken with the drawings making apparent to those skilled in the art how the several forms of the invention may be embodied in practice. In the accompanying drawings.

DETAILED DESCRIPTION OF THE EMBODIMENTS

Figure 1:
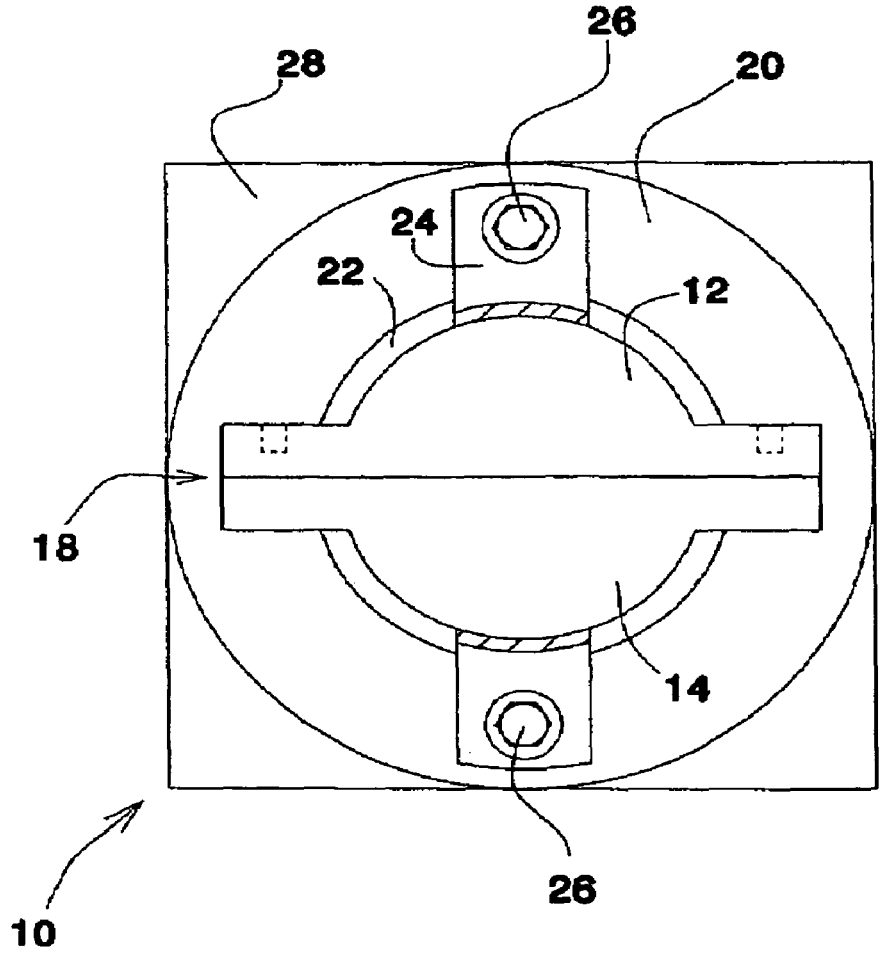
PRIOR ART FIG 1
FIG. 1 is an isometric projection of the prior art sensor housing described in U.S. Pat. No. 4,107,545 to Gittelis.

Referring now to FIG. 1, there is shown, in isometric projection, a vibration sensor unit 10 of the prior art, as widely installed on fencing, along international borders, around security installations and prisons and as described in U.S. Pat. No. 4,107,545 to Gittelis. The sensor unit 10 consists of a two part essentially spherical housing, having an essentially hemispherical top section 12 and an essentially hemispherical bottom section 14 fastened together by fasteners such as screws 16 (FIG. 2) for example. Through the essentially spherical housing, there is a channel 18, through which a signal cable may be run (not shown). The essentially spherical housing is supported by a back plate 20 having a concave socket 22 thereon that engages the essentially spherical housing. The essentially spherical housing is held against the socket 22 by a clasp 24 that encircles the essentially spherical housing and is attached to the back plate 20 by fixing means 26, typically bolts. The back plate 20 includes attaching means for attaching it to an installation. As shown herein, the attaching means is typically a second plate 28, such that when installation is a section of wire fencing, the wire fencing is sandwiched between the back plate 20 and second plate 28, perhaps using the fixing means 26.

The sensor unit housing is typically injection molded from polypropylene, polystyrene or other common plastic resin. To provide protection from UV damage, the casing plastic typically includes carbon black fillers.

Figure 2:
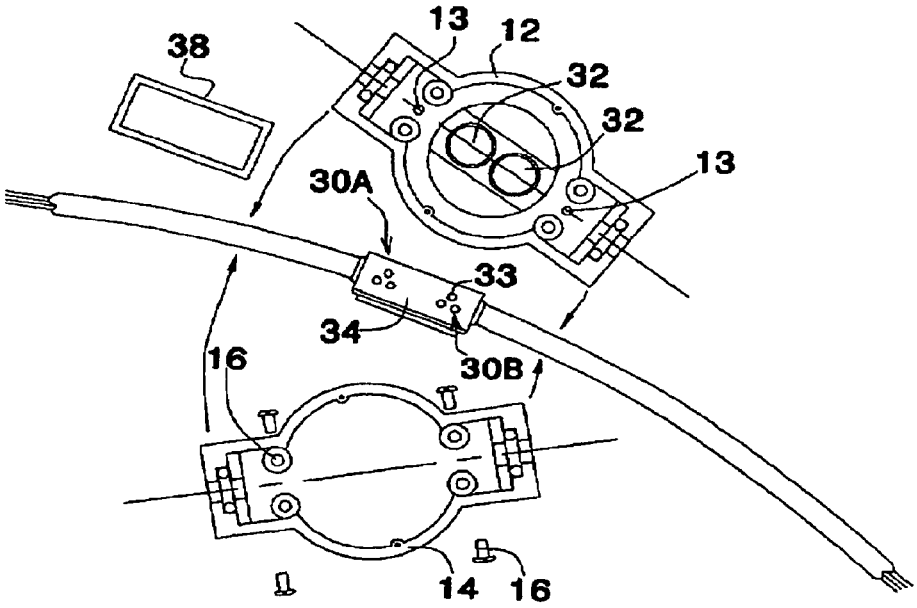
PRIOR ART FIG 2
FIG. 2 is an exploded isometric projection of the inside of the prior art sensor of FIG. 1.

As shown in FIG. 2, within the essentially spherical housing, sandwiched between the essentially hemispherical top section 12 and essentially hemispherical bottom section 14 of the prior art sensor housing, are two vibration sensors 30A, 30B in parallel, each comprising a low resistance ball 32 supported on a support 34 having three contact legs 33 defining a tripod. The supports 34 are attached to a base 38 that, in use, is oriented into perfect horizontal alignment, such that a sharp vibration tends to displace the low resistance ball 32 therein, generating a pulse signal along the cable.

The essential hemispherical top section 12 includes a pair of small blind holes 13 thereon, for attachment of a leveling devise, such as a spirit level, for accurate positioning of the essentially spherical housing during installation, such that the contact legs 33 of the sensors 30A, 30B may be perfectly aligned in a horizontal plane.

To provide high conductivity and long term protection against oxidation (tarnishing), the balls 32 and contact legs 33 are coated with gold.

Figure 3:
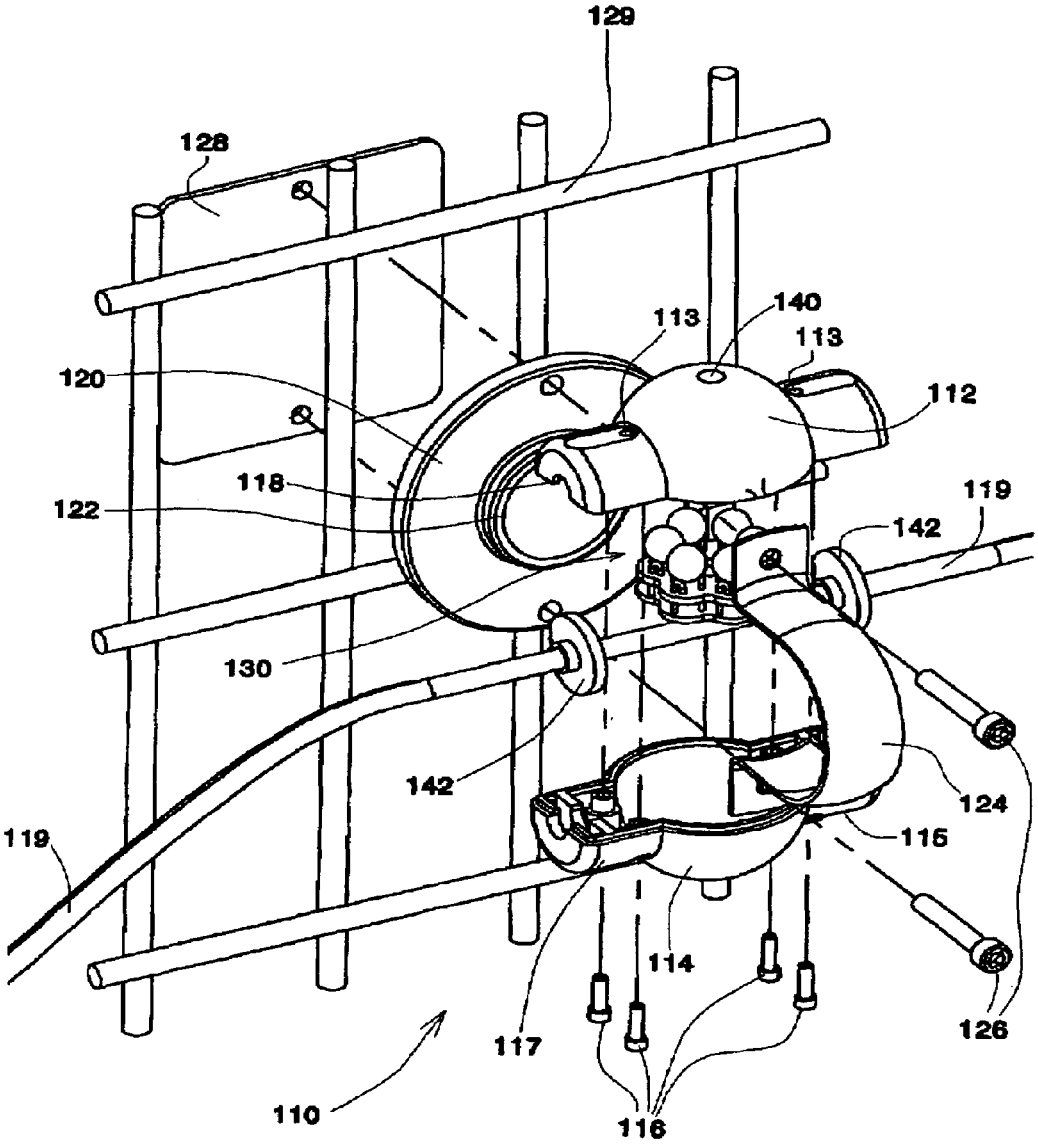
FIG. 3 is an exploded isometric projection of the improved sensor unit of the present invention, showing a six sensor arrangement.

With reference now to FIG. 3, there is shown, in exploded isometric projection, the improved sensor unit of the preferred embodiment of the present invention, being a sensor unit 110 consisting of a two part essentially spherical housing, having an essentially hemispherical top section 112 and an essentially hemispherical bottom section 114 fastened together by fasteners such as screws 116 for example. Through the essentially spherical housing, there is a channel 118, through which a signal cable 119 is run. The essentially spherical housing is supported by a back plate 120 having a concave socket 122 thereon that engages the essentially spherical housing. The essentially spherical housing is held against the socket 122 by a clasp 124 that encircles the essentially spherical housing and is attached to the back plate 120 by fixing means 126, typically bolts. The back plate 120 includes attaching means for attaching it to an installation. Small blind holes 113 are provided for leveling purposes during installation, for attaching leveling equipment, including a spirit level or plumb-line construction, for example. As shown herein, the attaching means is typically a second plate 128 such that when installation is a section of wire fencing 129 the wire fencing 129 is sandwiched between the back plate 120 and second plate 128, perhaps using the fixing means 126, as in the prior art casing shown in FIG. 1, mutatis mutandis. However, in contradistinction to the prior art, in the preferred embodiment 110, within the essentially spherical housing, there are provided six sensors 130 arranged in a hexagon arrangement and connected in series. Using six sensors 130 per housing, rather than two, as in the prior art, provides a very high degree of reliability indeed, and allows long term trouble free use. In the center of the essentially hemispherical top section 112 a central blind hole 140 is provided. The central blind hole 140 is essentially a tube having an opening in the top of the essentially hemispherical top section 112, and a closed bottom end, the purpose of which will be explained hereinbelow, with reference to FIG. 10. Both the essentially hemispherical lop section 112 and the essentially hemispherical bottom section 114 include half cylindrical extensions having half disk shaped slots therein 115, 117 for engaging a sealing adapter disk 142 therein. The sealing adapter disk engages the signal cable 119, providing a watertight fit there around.

Now, the typical behavior of sensor units 10 of the prior art with respect to vibrations caused by the elements, particularly wind and rain, is known. Consequently, despite having radically different internal elements and additional features, the sensor unit 110 of the present invention, preferably has the same size and shape as the sensor unit 10 of the prior art.

Figure 4:
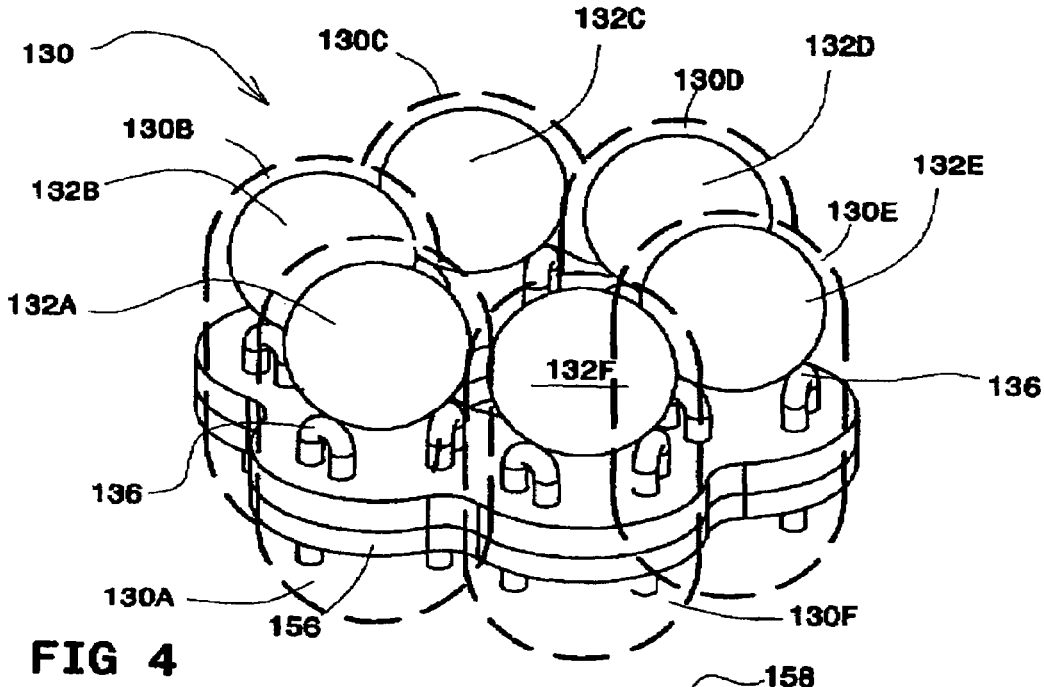
FIG. 4 is an isometric projection of the six sensor arrangement from above.
Figure 5:
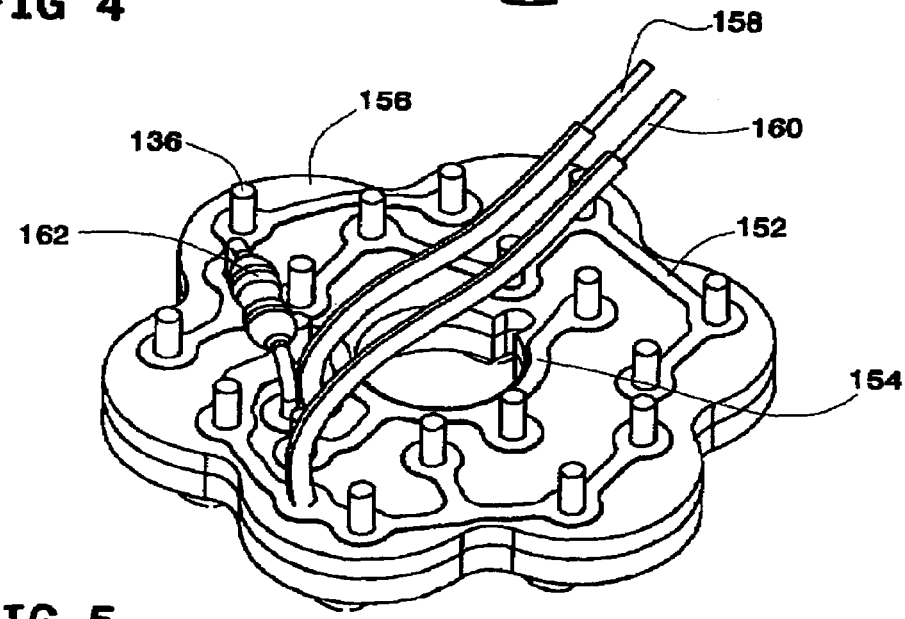
FIG. 5 is a view of the printed circuit board connecting the legs of the individual sensor mountings from below, showing how a resistor is usefully corrected in series with the sensor mountings, to provide a significant resistance to the sensor housing as a whole.

FIG. 4 is an isometric projection showing the six sensor arrangement 130 from above, in which the six gold plated balls 132A-132F arranged in a hexagonal configuration are shown, as are the support contact legs 136 of the individual sensors, three of which, arranged in an equilateral triangle formation, support each ball 132. The six sensors 130A-130F are connected in parallel. Referring to FIG. 5, the support legs 136 are connected in two rings 152, 154, such that the two rings 152, 154 are interconnected by the gold plated balls 132 (FIG. 4) resting thereon. Optionally and preferably, the base of the six sensor arrangement 130 comprises two layers, the base layer 156 being a printed circuit board, PCB, such that the support legs 136 pass therethrough. In this manner, the six sensors 130A-130F of the six sensor array 130 are connected in parallel. Attached to the two rings 152, 154 are two contact wires 158, 160 which connect to one of the signal wires within the cable 119 (FIG. 3). Ideally, the cable 119 includes a bundle of such wires, such that adjacent sensor units 110 may be mounted on different wires thereby allowing the comparison of signals generated by adjacent sensor units 110 on adjacent sections of fencing 129, allowing bulk disturbances, such as the fence swaying in the wind, to be accounted for and ignored. It is a particular feature of the preferred embodiment, that a resistor 162 is included in series with the six sensor arrangement 130, such that the sensor unit 110 as a whole, has a positive, significant resistance. This provides an additional security measure, in that if the sensor unit 110 is bypassed by a shorting wire, the signal strength increases noticeably, providing an indication of sabotage, and overcoming this disadvantage of the prior art.

Figure 6:
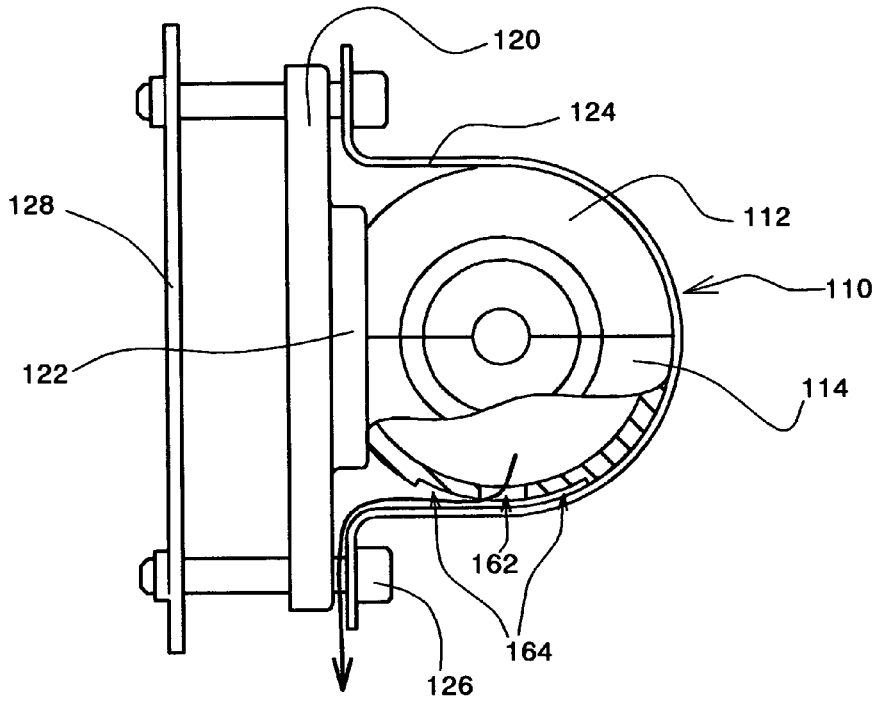
FIG. 6 is a partially cutaway side view of sensor mounting arrangement, showing improved drainage hole therein.

With reference to FIG. 6, a sensor unit 110 of the preferred embodiment is shown, in partially cutaway side view. Of note, the drainage hole 162 is mounted in an external slot 164, providing drainage, even though the clamp 124 covers the drainage hole 162. This prevents moisture accumulating within the sensor housing, which is one cause of malfunction of the sensor units 10 (FIG. 1, 2) of the prior art.

Figure 7A:
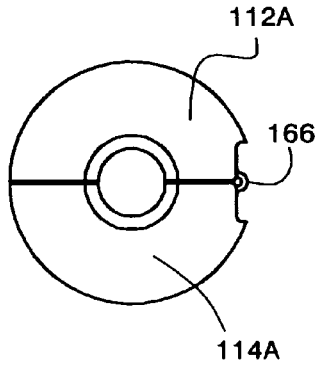
FIG. 7A shows a hinged casing arrangement, closed position.
Figure 7B:
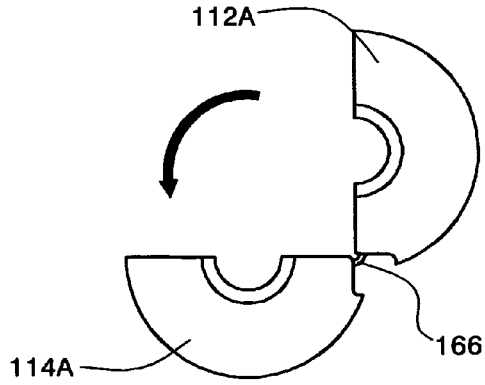
FIG. 7B shows a hinged casing arrangement, open position.

Referring to FIG. 7, in one embodiment, the two hemispherical parts 112A, 114A of the sensor housing may be hinged together by a hinge 166, such that the housing may be closed (FIG. 7A) or opened (FIG. 7B).

Figure 8:
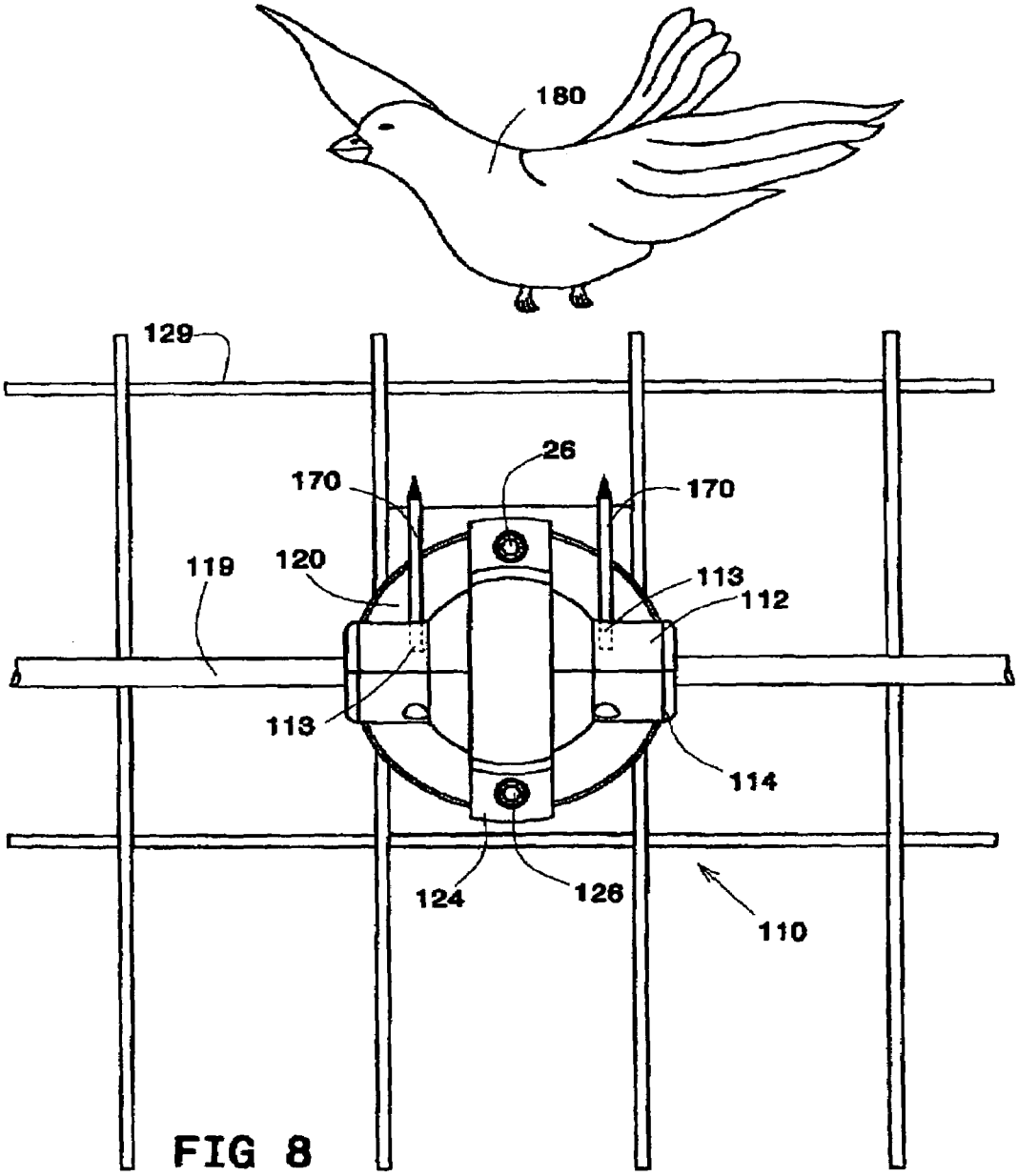
FIG. 8 shows a protective feature to prevent birds disturbing sensor housing.

Referring to FIG. 8, in one embodiment, spikes 170 are provided, which may be mounted in the small blind holes 113 provided for leveling purposes. These spikes 170 protrude upwards from the housing. These prevent birds 180, such as pigeons etc., from roosting on the housing, this protective feature prevents birds from disturbing the sensor housing 110 which is one known cause of prior art sensor units (FIG. 1) from becoming displaced from the horizontal. Indeed, woodpeckers and magpies have been known to tap holes through the prior art housings 10, and such spikes 170 are anticipated to deter such birds as well.

Figure 9:
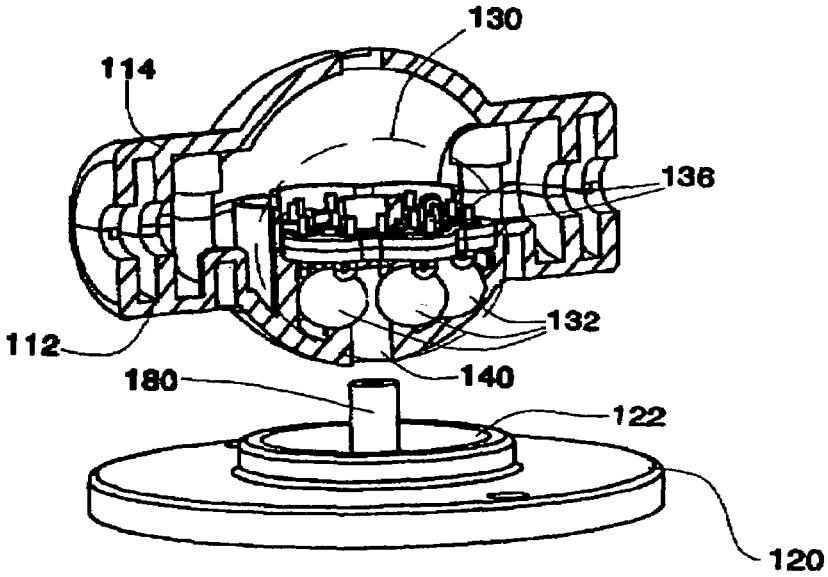
FIG. 9 shows, in cut away cross sectional view, the sensor of the embodiment of FIG. 3, mounted upside-down on a peg attached to a horizontally lying back-plate for transportation purposes.

With reference to FIG. 9, as mentioned hereinabove with reference to FIG. 3, in the center of the essentially hemispherical top section 112 a central blind hole 140 is provided. The central blind hole 140 is essentially a tube having an opening in the top of the essentially hemispherical top section 112, and a closed bottom end, the purpose of which is to allow the sensor housing to be mounted upside down, on a peg 180 that may be mounted in a hole provided for that purpose in the middle of the socket 122 of a back plate 120, the hole arranged such that the back plate 120 is arranged horizontally. In consequence, the gold plated balls 132 of the sensors 130 within the inverted upper shell 112 are disconnected from the gold plated contact legs 136. In this manner, the sensor units 110 may be safely transported, with wear damage to balls 132 and legs 136 being prevented.

Figure 10:
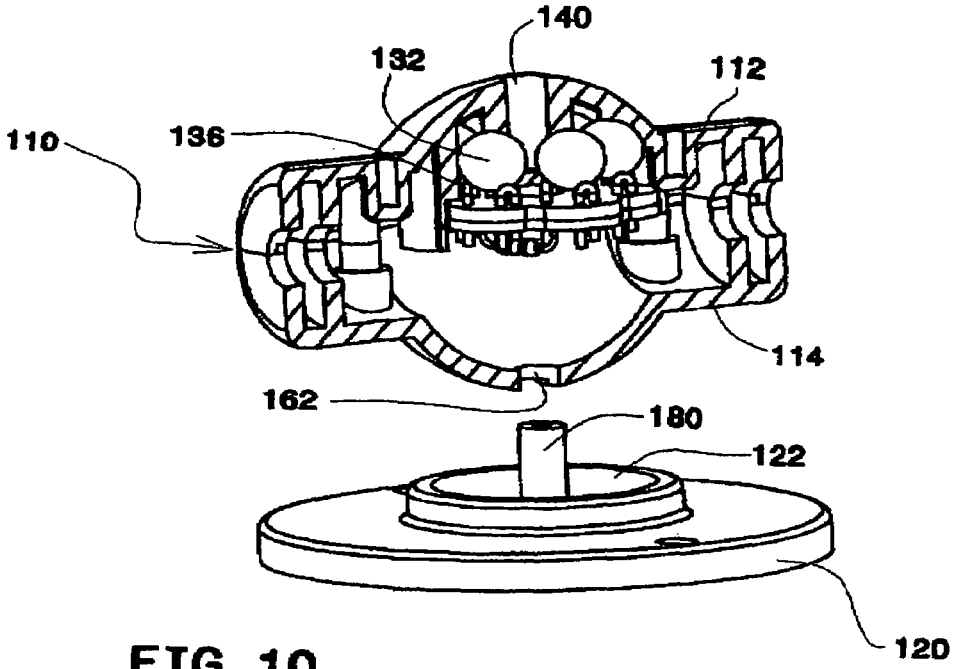
FIG. 10 shows, in cut away cross sectional view, the sensor of the embodiment of FIG. 3, mounted right side up on a peg attached to a horizontally lying back-plate for testing purposes.

With reference to FIG. 10, for purposes of testing, the sensor housing may be mounted in the upright position on a horizontally lying back plate 120, by engaging the drainage hole 162 on the peg 180. In this manner, the correct functioning of the sensor unit 110 may be tested in the lab prior to dispatch, or in the field, prior to mounting.

Figure 11:
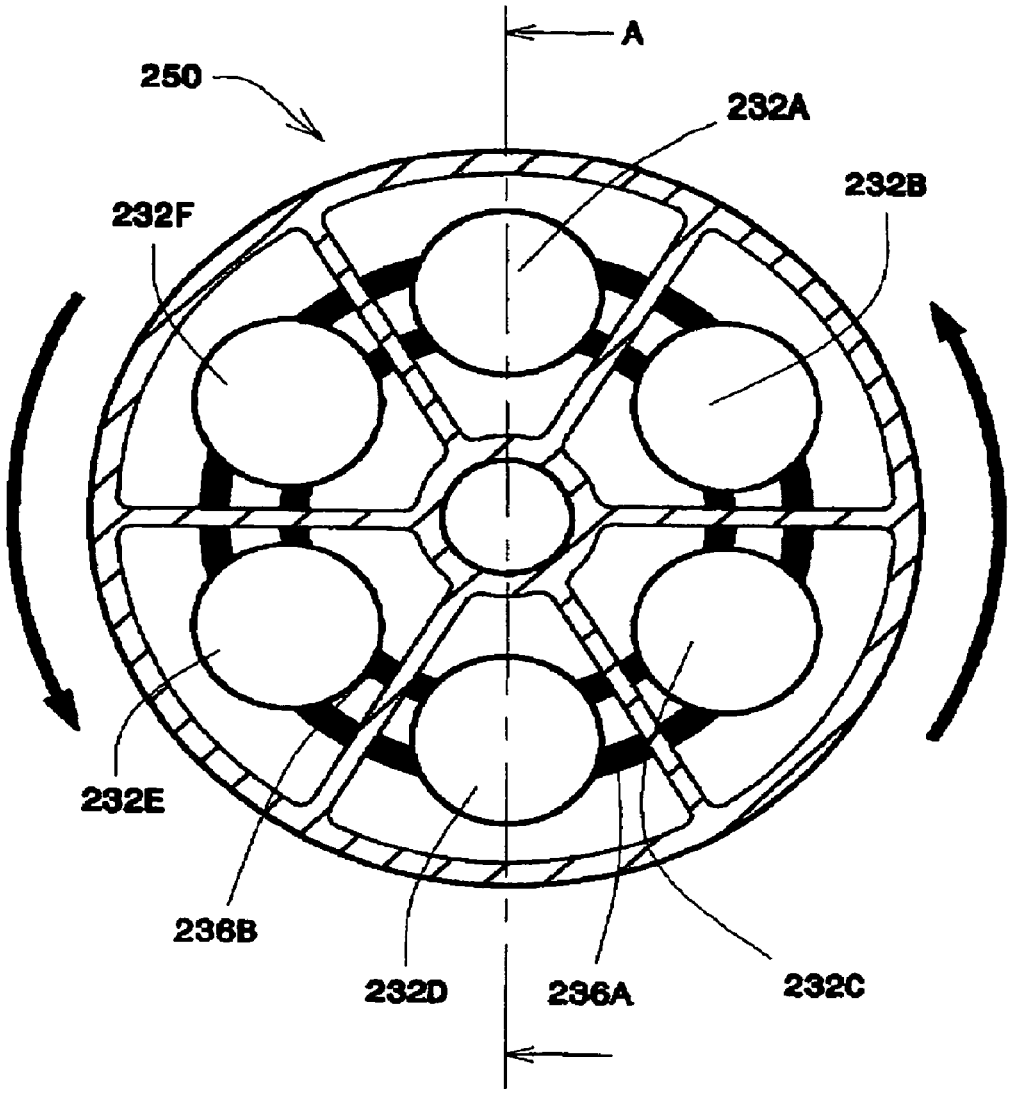
FIG. 11 shows a second embodiment having an alternative six sensor arrangement.

Persons skilled in the art will appreciate that the present invention is not limited to what has been particularly shown and described hereinabove. Rather the scope of the present invention is defined by the appended claims and includes both combinations and subcombinations of the various features described hereinabove as well as variations and modifications thereof, which would occur to persons skilled in the art upon reading the foregoing description. Thus, with reference to FIG. 11, it will be appreciated that there are alternative six sensor arrangements 250, such as mounting six balls 232A-232F on a pair of concentric rings 236A, 236B instead of on tripod mounts.

As discussed hereinabove, the improvements of the present invention are based, in the main, on using a six sensor arrangement including six parallel mounted sensors within a single sensor housing. The six sensor arrangement has a life expectancy of 12 to 15 years continuous use, instead of the 8 to 10 years working life displayed by the sensor units of the prior art. Additionally, it will be appreciated that there are considerable cost savings in mounting one sensor housing per stretch of fencing rather than two. Furthermore, since many installations are along hostile borders, mining the time spent in setting up and balancing sensors and in their field maintenance cuts down on cost and may even save lives.

Figure 12:
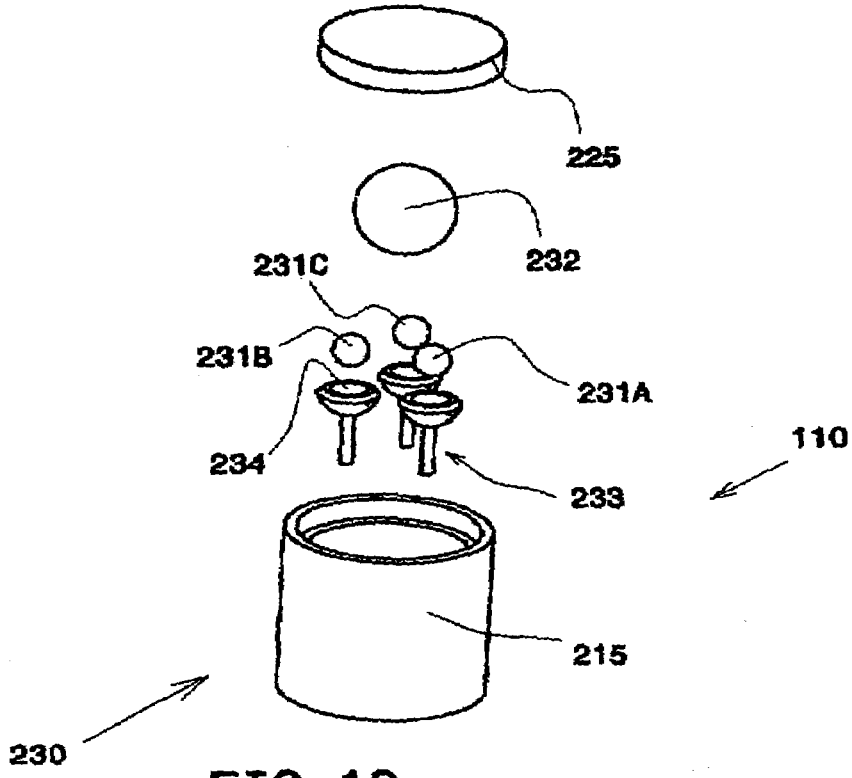
FIG. 12 shows, in exploded isometric projection, an alternative sensor having long-term reliability.
Figure 13:
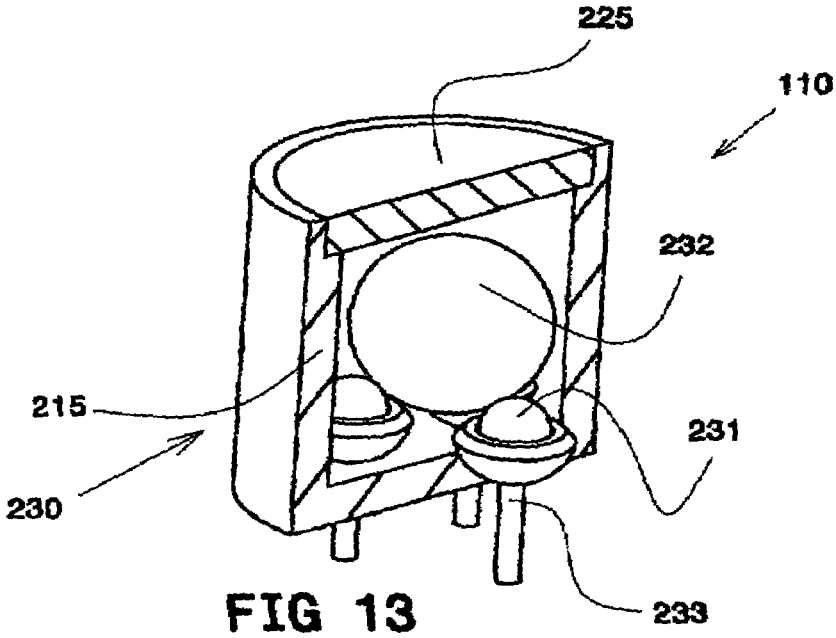
FIG. 13 shows, in cut away isometric projection of the assembled sensor of FIG. 12.

One mode of failure of the prior art sensor 30 was failure due to wear of the gold coating on the support legs 33 at the point of contact with the sphere 32. With reference to FIGS. 12 and 13, an alternative vibration sensor 230 is shown, where, like sensor 30, 130 the alternative vibration sensor 230 is based on a sphere 232 supported on three supports 233. However, in contradistinction to the prior art sensor 32 shown in FIG. 2, the legs 233 terminate in concave cups 234 in which miniature ball bearings 231A-C having a diameter of perhaps 2 mm or so, are situated. These miniature ball bearings 231A-C, like the legs 233 and spheres 232 are gold plated. The mounting legs 233 of the sensor of the improved sensor 230 thus represent miniature golf tees. Within the multiple sensor housing 110 (10), a plurality of such sensors is encased in an individual sensor casing 215 having a lid 225. In this manner, a closed casing is formed such that when correctly assembled, the spheres 232, 231A-C can rattle around but cannot be permanently dislodged (FIG. 13). Such an alternative vibration sensor 230 is superior to the prior art sensor 30 (130), in that contact with each leg 233 is distributed over a substantial area of the cup 234. Furthermore, as vibrations disturb the main sphere 232, the miniature spheres 231A-C jiggle around and rotate slightly. In this manner, new areas of both the main and miniature spheres 232, 231A-C are brought into contact, and failure of sensor 230 due to damage of gold coating on contact between legs 233 and sphere 232 is virtually eliminated.

Although typically used for safeguarding security fences by detecting vibrations thereof, It will be appreciated that the vibration sensor unit 110, may be used for other purposes and in other scenarios where vibration monitoring is required, such as in earthquake research for example, and such sensors may be mounted on many different substrates.

In the claims, the word "comprise", and variations thereof such as "comprises", "comprising" and the like indicate that the components listed are included, but not generally to the exclusion of other components.

The invention claimed is:

1. In a security fence, a vibration sensor unit comprising a sensor housing consisting of an essentially hemispherical top section and an essentially hemispherical bottom section fastened together by fasteners and having a channel therethrough, through which a signal cable may be run; the sensor housing being supported by a back plate having a concave socket thereon that engages the essentially spherical housing, allowing accurate positioning of sensors therein, with respect to the horizontal; the essentially spherical housing being held against the socket by a clasp that encircles the sensor housing therearound, and being attached to the back plate by fixing means; the back plate including attaching means for attaching it to an installation, wherein the sensor unit comprises six sensors connected in parallel, each sensor comprising a conductive ball supported on electrical contacts, wherein each of said electrical contacts being three miniature spheres, each supported in a cup, thereby as vibrations disturb said conductive ball, said miniature spheres jiggle around and rotate slightly, resulting in contact of new areas of said ball with each of said miniature spheres, thereby prolonging the lifetime of said sensor.

2. The vibrating sensor unit of claim 1, wherein said electrical contacts are a pair concentric rings, the six sensor balls each contacting both concentric rings.

3. The vibrating sensor unit of claim 1, wherein the six sensors are arranged in a hexagon arrangement.

4. The vibrating sensor unit of claim 1, wherein the attaching means is a second plate, such that when installation is a section of wire fencing, a portion of the wire fencing is sandwiched between the back plate and second plate, perhaps using the fixing means.

5. The vibrating sensor unit of claim 1, wherein the six sensors are connected in parallel by being mounted on a printed circuit board having two rings of contacts.

6. The vibrating sensor unit of claim 1, further comprising a resistor in series with the sensors, providing a significant electrical resistance to sensor unit as a safeguard against being undetectably shorted out.

7. The vibrating sensor unit of claim 1, wherein there is provided an improved drainage hole in the lowest point of the bottom hemispherical piece, the improvement being that the drainage hole is mounted within a shallow slot thereby preventing it being blocked by the clamp therearound.

8. The vibrating sensor unit of claim 1, wherein a blind hole comprising a tube having an opening in the top end thereof, and a closed bottom end, is provided in center of the essentially hemispherical top section at highest point thereof, enabling the fixing of a pin therein, thereby enabling the sensor unit to be mounted upside down in the socket of a horizontally mounted back plate, via a hole for head of said pin, facilitating substantially wear free transportation thereby.

9. The vibrating sensor unit of claim 1, having vertical spikes mounted thereon to deter perching birds.

10. In a security fence, a vibration sensor comprising a conductive ball supported on three electrical contact supports arranged in an equilateral triangle arrangement, wherein each contact support comprising a miniature sphere supported in a cup thereby as vibrations disturb said conductive ball, said miniature spheres jiggle around and rotate slightly, resulting in contact of new areas of said ball with each of said miniature spheres, thereby prolonging the lifetime of said sensor.

11. A system for giving warning of infiltration of a security fence, by detecting vibrations of said fence, comprising a series of sensor units as claimed in claim 1, connected via a cable to a processing means and alarm means.

12. The system of claim 11 wherein each section of fencing between adjacent support posts has only one sensor thereon.

* * * * *